US008050544B2

(12) United States Patent
Zametzky

(10) Patent No.: US 8,050,544 B2
(45) Date of Patent: Nov. 1, 2011

(54) ELECTRONIC DEVICE FOR REGULATING THE VOLTAGE ACROSS A HIGH-SIDE LOAD

(75) Inventor: Klaus Zametzky, Schwabach (DE)

(73) Assignee: SITRONIC Ges. fuer elektrotechnische Ausruestung mbH & Co. KG, Gaertringen (DE)

( * ) Notice: Subject to any disclaimer, the term of this patent is extended or adjusted under 35 U.S.C. 154(b) by 573 days.

(21) Appl. No.: 12/224,320

(22) PCT Filed: Feb. 14, 2007

(86) PCT No.: PCT/DE2007/000268

§ 371 (c)(1),
(2), (4) Date: Oct. 3, 2008

(87) PCT Pub. No.: WO2007/095898

PCT Pub. Date: Aug. 30, 2007

(65) Prior Publication Data

US 2009/0148140 A1 Jun. 11, 2009

(30) Foreign Application Priority Data

Feb. 25, 2006 (DE) ..... 10 2006 008 839

(51) Int. Cl.
*G05F 1/10* (2006.01)

(52) U.S. Cl. ..... 388/833; 388/825; 388/830

(58) Field of Classification Search ..... 388/825, 388/830, 833

See application file for complete search history.

(56) References Cited

U.S. PATENT DOCUMENTS

| | | | | |
|---|---|---|---|---|
| 3,731,170 | A * | 5/1973 | Emmert | 318/257 |
| 3,851,235 | A * | 11/1974 | Harrison, Jr. | 318/257 |
| 4,079,308 | A | 3/1978 | Brown | |
| 4,232,261 | A | 11/1980 | Lingstaedt et al. | |
| 4,806,832 | A * | 2/1989 | Muller | 388/833 |
| 6,133,701 | A * | 10/2000 | Gokturk et al. | 318/114 |
| 2002/0131286 | A1 * | 9/2002 | Zametzky | 363/132 |
| 2009/0027032 | A1 * | 1/2009 | Zametzky | 323/316 |
| 2009/0121667 | A1 * | 5/2009 | Zametzky | 318/434 |

FOREIGN PATENT DOCUMENTS

| | | |
|---|---|---|
| JP | 58107921 | 6/1983 |
| JP | 01302409 A | 6/1989 |

OTHER PUBLICATIONS

Tietze, Schenk: Halbleiterschaltungstechnik. 11. Auflage, Springer-Verlag Berlin, 1999, S. 964-968.

* cited by examiner

*Primary Examiner* — Walter Benson
*Assistant Examiner* — Kawing Chan
(74) *Attorney, Agent, or Firm* — Walter A. Hackler

(57) ABSTRACT

The invention relates to an electronic control device for regulating the voltage across a high-side load, especially for regulating a fan in a motor vehicle, with a control voltage (V1) which is referenced to system ground and which is mirrored to the positive high-side supply voltage, wherein the control voltage (V1) is supplied to the base of a first transistor (Q1) operated in common-emitter connection, which transistor (Q1) has, in the emitter circuit, a first resistor (R1) and, in the collector circuit, a second resistor (R2) and, in series with the latter, the base-emitter diode of a second transistor (Q2). Compensation for temperature effects of the base-emitter voltage of the first transistor is performed by the base-emitter path of a second transistor of the same conductivity type in series with the first transistor.

4 Claims, 1 Drawing Sheet

ELECTRONIC DEVICE FOR REGULATING THE VOLTAGE ACROSS A HIGH-SIDE LOAD

CROSS-REFERENCE TO RELATED APPLICATIONS

This application is the National Stage Entry of International Application Number PCT/DE2007/000268, filed Feb. 14, 2007, which claims benefit of priority of German Patent Application Number 10 2006 008 839.5, filed Feb. 25, 2006.

BACKGROUND OF THE INVENTION

The invention relates to an electronic device for regulating the voltage across a high-side load, especially for regulating a fan in a motor vehicle.

Such control devices are generally known through their use in motor vehicles.

There is known through JP 01302409 AA or DE 2708021 C3 an electronic control device in which a control voltage referenced to the positive high-side supply voltage is used as the command variable for the regulation.

An important fundamental function of the control device is to regulate the motor voltage in dependence on a control signal. That control signal may be an analogue control voltage, an analogue control current or a digital signal. Control devices for fans in accordance with the teaching of the prior art convert control currents and digital control signals internally into a control voltage, so that in principle there is always a control circuit that regulates the motor voltage as a function of a control voltage.

Known linear control devices for fans use in general the circuit topology illustrated in FIG. 2. A vehicle battery V2 provides the power supply for the entire arrangement. V1 provides the control voltage. $U_{mot}$ is the motor voltage. An operational amplifier U1A sets its output voltage and hence the gate-source voltage of the MOS transistor M1 in such a way that U+ is approximately equal to U−. The arrangement may be described by suitable equations. If R1/R2=R3/R4 is selected, the following relationship is obtained for control voltage V1 and motor voltage $U_{mot}$:

$$U_{mot} = V_1 \cdot \frac{R_2}{R_1}$$

An important requirement to be met by a control device for a fan is the correction of on-board voltage fluctuations. $U_{mot}$ should be independent of V2. That applies only when R1/R2=R3/R4. The behaviour of the control device shown in FIG. 2 is therefore dependent on the matching tolerance of the voltage dividers R1/R2 and R3/R4 in the case of on-board voltage fluctuations dV2.

Assuming ideal components and ideal matching tolerance R1/R2=R3/R4, the relationship $U_{mot}$=f(V1) is determined only by the resistance ratio R1/R2. $U_{mot}$ is largely independent of V2. The operational amplifier corrects on-board voltage fluctuations. In standby operation, V1=0. The current consumption Ib of the arrangement is in this case described as closed-circuit current and should be as low as possible so as not to discharge the battery V2.

In the case where V1=0, $U_{mot}$=0 and hence also Id=0 (modern mosfets have very small is cut-off currents). Accordingly, Ib=I1+I2+I3. I3 can be kept at a very low level by the use of an ultra-low-power opamp.

If it is desired for reasons of costs to dispense with encapsulation of the controller electronics, then the use of high-resistance resistors is problematic. Condensation and the associated contamination on the printed circuit board surface, which occur in the vehicle, lead to tracking currents which affect the functioning of circuits dimensioned to be of high-impedance. R1 to R4 cannot, therefore, be made to be high-resistance to an arbitrarily high degree. Thus, I1 and I2 load the battery in standby operation.

The problem underlying the invention is to develop a control device that permits relatively low-resistance resistors to be used even in the case of low closed-circuit current consumption, while compensating for thermal effects on the command variable.

SUMMARY OF THE INVENTION

The problem is solved by a control device in accordance with patent claim 1. Advantageous developments of the invention are given in patent claims 2 to 4.

The invention makes it possible to construct a control device, especially for a fan, using comparatively few discrete components. The control device is distinguished by having a good regulating behaviour and an extremely small closed-circuit current consumption. Compensation for temperature effects of the base-emitter voltage of the first transistor is performed by the base-emitter path of a second transistor of the same conductivity type in series with the first transistor.

BRIEF DESCRIPTION OF THE DRAWINGS

A preferred illustrative embodiment of the invention is illustrated schematically in the drawings and will be described hereinafter with reference to the Figures of the drawings, in which.

DETAILED DESCRIPTION

Figure 1:
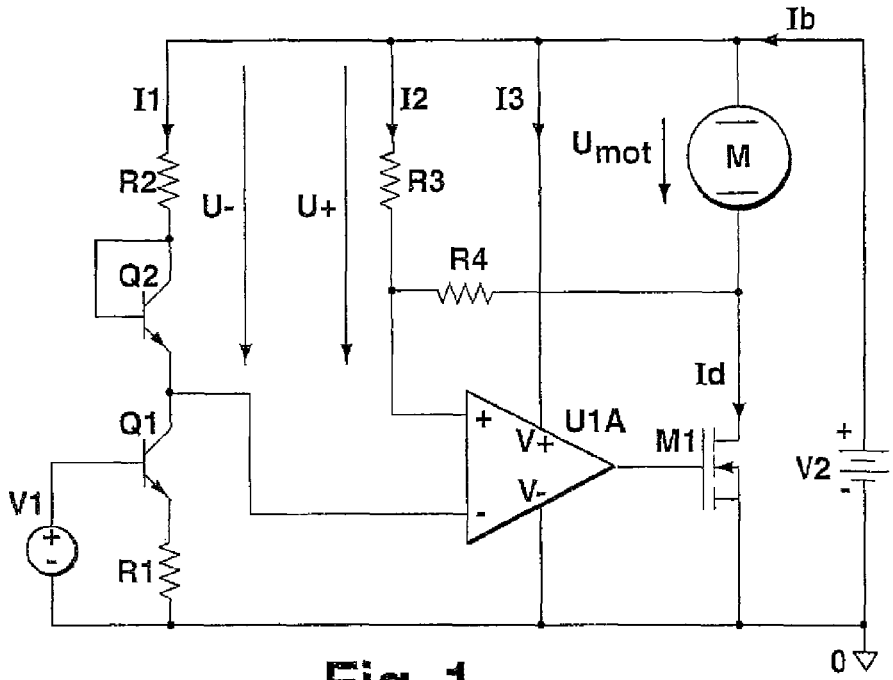
FIG. 1 shows a circuit diagram of a control device according to the invention.

As shown in FIG. 1, in this arrangement the control voltage V1 which is referenced to ground is not applied ground-referenced to the control amplifier as in the circuit diagram of the known control device (see FIG. 2), but is mirrored to the positive supply voltage. The input voltages U+ and U− of the control operational amplifier are not, as in FIG. 2, referenced to ground but are referenced to the positive potential of the supply voltage V2.

The control voltage V1 is fed to the base of a transistor Q1 operated in common-emitter connection. Connected in the emitter circuit thereof, there is a resistor R1 and, in the collector circuit thereof, a resistor R2 and, in series with the latter, the base-emitter diode of a further transistor Q2. The voltage U−, which drops across R2 and Q2, is now given by U−=Ube(Q2)+R2/R1*(V1−Ube(Q1)). The voltage U− now corresponds approximately to the input voltage V1 amplified by R2/R1.

Selecting R1=R2 and Q1/Q2 with matched characteristics, U− is an exact image of V1. It is especially advantageous for the two transistors Q1 and Q2 to be thermally coupled, then the condition Ube(Q1)=Ube(Q2) is satisfied to a good approximation also in the case of temperature fluctuations. V1 is referenced to ground, U− is referenced to the positive potential of V2. By that arrangement, therefore, V1 is mirrored from the ground reference potential to the positive supply potential.

The two input voltages of the controller U1A may be referenced to the positive supply voltage U2. Thus, according to the circuit diagram shown in FIG. 1, $U_{mot}$ is:

$$U_{mot} = V_1 \cdot \frac{R_3 + R_4}{R_3}$$

and is thus independent of V2.

Figure 2:
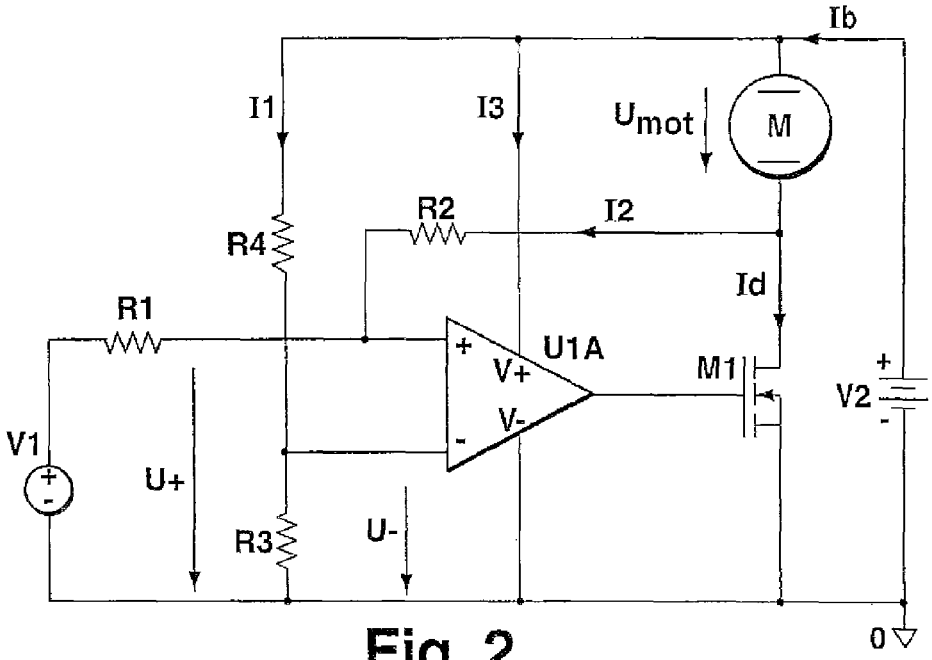
Fig. 2 (PRIOR ART)
FIG. 2 shows a circuit diagram of a known control device.

Resistance matching tolerances are not included in the relationship $dU_{mot}=f(dV2)$ in contrast to the circuit diagram shown in FIG. 2.

According to the teaching of the invention, better correction of on-board voltage fluctuations is therefore achieved.

The closed-circuit current of the circuit may be given only by the closed-circuit current of the controller U1A. In the case where V1=0, Q1 becomes non-conductive. Hence, it follows that I1=0, U−=U+=0, Id=0, I2=0 and Ib=I3.

Even in the case of low-resistance dimensioning, I1 and I2 do not load the battery V2 in closed-circuit operation.

The invention claimed is:

1. An electronic control device for regulating the voltage across a high-side load, especially for regulating a fan in a motor vehicle, with a control voltage (V1) which is referenced to system ground and which is mirrored to positive high-side supply voltage, wherein the control voltage (V1) is supplied to the base of a first transistor (Q1) operated in common-emitter connection, which transistor (Q1) has, in the emitter circuit, a first resistor (R1) and, in the collector circuit, a second resistor (R2) and, in series with the latter, the base-emitter diode of a second transistor (Q2);

the second transistor (Q2) is of the same conductivity type as the first transistor (Q1);

the first and second transistors (Q1, Q2) are parameter-matched, thermally coupled transistors of the same conduction type;

the base-emitter diode of the second transistor (Q2) compensates for effects of the base-emitter diode of the first transistor (Q1), whereby the voltage drop across the series connection composed of the base-emitter path of the second transistor (Q2) and the second resistor (R2) is an exact image of the voltage drop across the series connection composed of the base-emitter path of the first transistor (Q1) and the first resistor (R1);

the voltage drop across the series connection composed of the base-emitter section of the second transistor (Q2) and the second resistor (R2) serves as a command variable for the regulation.

2. An electronic control device according to claim 1 wherein, the input voltages supplied to a controller (U1A) are referenced to the positive high-side supply voltage by which the load is supplied.

3. An electronic control device according to claim 1 wherein the regulation of the load voltage in the case of supply voltage fluctuations is independent of a resistance matching.

4. An electronic control device according to claim 1 wherein the arrangement of the electronic control device has a closed-circuit current consumption which is independent of the dimensioning of the resistors (R1 to R4).

* * * * *